United States Patent [19]

Terpening

[11] 4,093,210

[45] June 6, 1978

[54] FINGER/ARM FRICTION TYPE EXERCISING DEVICE

[75] Inventor: George I. Terpening, Telford, Pa.

[73] Assignee: Acro Matic, Inc., Warrington, Pa.

[21] Appl. No.: 803,149

[22] Filed: Jun. 3, 1977

[51] Int. Cl.[2] ..... A63B 23/00; A63B 21/26; A63B 21/30

[52] U.S. Cl. ..... 272/67; 272/132; 272/143; 272/DIG. 3

[58] Field of Search ..... 272/67, 68, 119, 128, 272/132, DIG. 3, 143, 131; 273/DIG. 17, DIG. 19; 46/51

[56] References Cited

U.S. PATENT DOCUMENTS

| | | | |
|---|---|---|---|
| 1,047,212 | 12/1912 | Hamilton | 272/119 |
| 2,819,081 | 1/1958 | Touraine | 272/67 |
| 3,186,124 | 6/1965 | Voss | 272/143 X |
| 3,200,536 | 8/1965 | Petitto | 46/51 |
| 4,039,184 | 8/1977 | Sakurada | 272/67 |

FOREIGN PATENT DOCUMENTS

| | | | |
|---|---|---|---|
| 487,905 | 12/1952 | Canada | 273/DIG. 17 |

*Primary Examiner*—William R. Browne
*Attorney, Agent, or Firm*—William B. Noll

[57] ABSTRACT

An exercising device for the strengthening of the superficial and deep muscles of the forearm. Such device, to be attached to or worn on a person's waist, is particularly suitable to develop the muscles used in racket type games such as tennis, paddle tennis, squash, etc. Such device includes a base member attached or worn on a person's waist, a wheel mounted for rotation on a base member projection, mechanism cooperating between said base member projection and said wheel to resist the force needed to effect rotation of said wheel on said base member, and a mechanism to vary pressure on the wheel to vary the manual force necessary to turn the wheel. To properly develop such muscles, thumb positioning supports are provided on said base member to position the wearer's hand while such wearer's fingers engage and rotate said wheel.

6 Claims, 4 Drawing Figures

FIG. 2
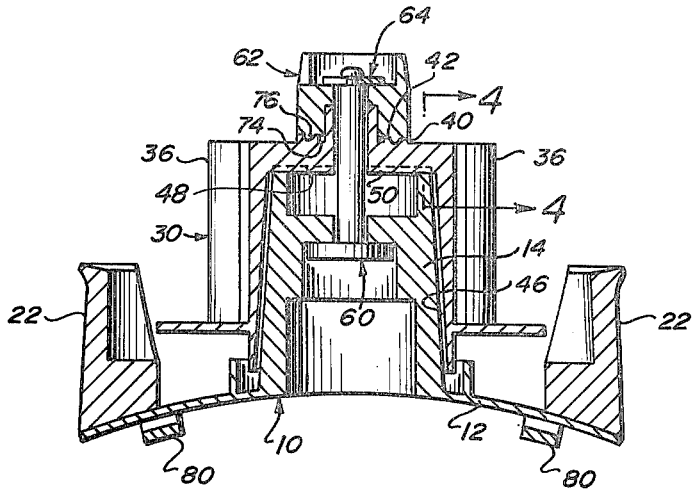
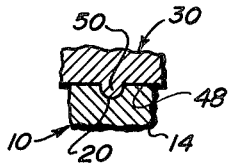
FIG. 4
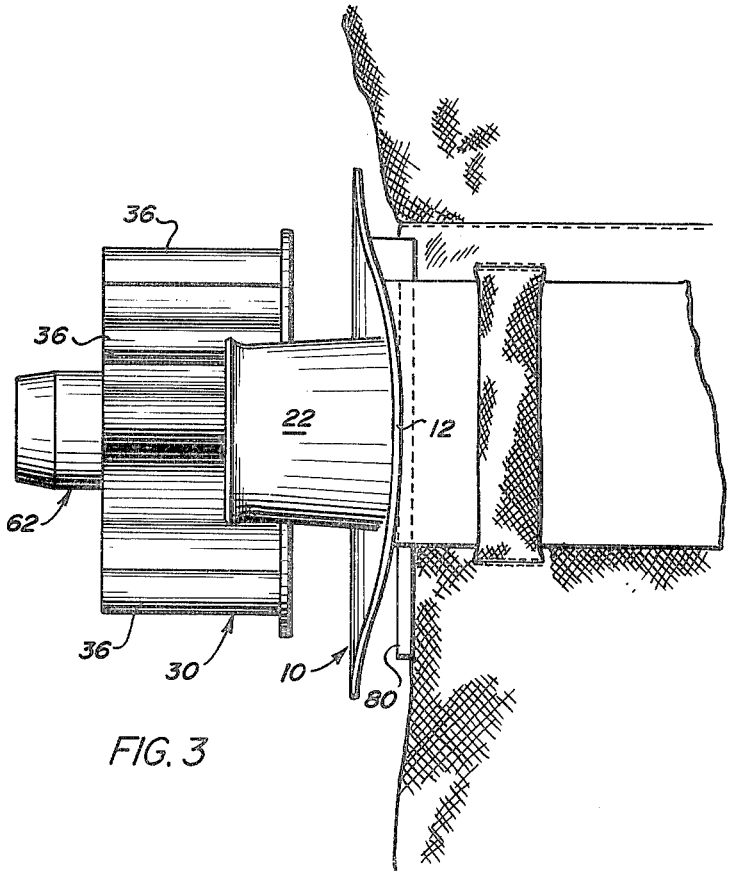
FIG. 3

FINGER/ARM FRICTION TYPE EXERCISING DEVICE

BACKGROUND OF THE INVENTION

The present invention relates to an exercising device to promote the development of the arm muscles used in racket-type games, such as tennis, paddle tennis, squash, etc. More particularly, said invention relates to a device to be attached to or worn on the user's waist for the purpose of strengthening the superficial and deep muscles of the forearm.

The function of any exercising device or apparatus is to tone up the various muscles of the body. Familiar examples of such exercising apparatus are gymnasium pull weights, rowing machines, and extensible spring devices. Most of such apparatus is directed to strengthening the leg, back, and upper arm muscles. Further, such apparatus is generally not suited for home use.

Little attention has been devoted to devices for the development of the lower arm muscles, particularly devices which are not limited to gymnasium type establishments. The present invention fills that need to provide a compact and readily usable device to strengthen the muscles of the forearm, particularly the superficial and deep muscles thereof.

SUMMARY OF THE INVENTION

This invention is directed to an exercising device to strengthen the superficial and deep muscles of the forearm. Such muscles play a prominent role, for example, in the development of a smooth and firm stroke of a tennis player. Said exercising device comprises a base member attached or worn on a person's waist, a wheel mounted for rotation on said base member, and means cooperating between said base member and said wheel to control the force needed to effect rotation of said wheel on said base member. To properly develop such muscles, a thumb positioning support is provided on said base member to position such person's hand while his fingers engage and rotate said wheel.

BRIEF DESCRIPTION OF THE DRAWINGS

FIG. 2 is a sectional view taken through the center of the assembled exercising device of FIG. 1.

FIG. 3 is a side view of the assembled exercising device of FIG. 1 showing the manner such device is worn by a person in preparation for use of such device.

FIG. 4 is a partial sectional view taken along line 4—4 of FIG. 2 showing the rotating wheel's inner surface which interacts with the base member during rotation of said wheel.

DETAILED DESCRIPTION OF PREFERRED EMBODIMENT

Figure 1:
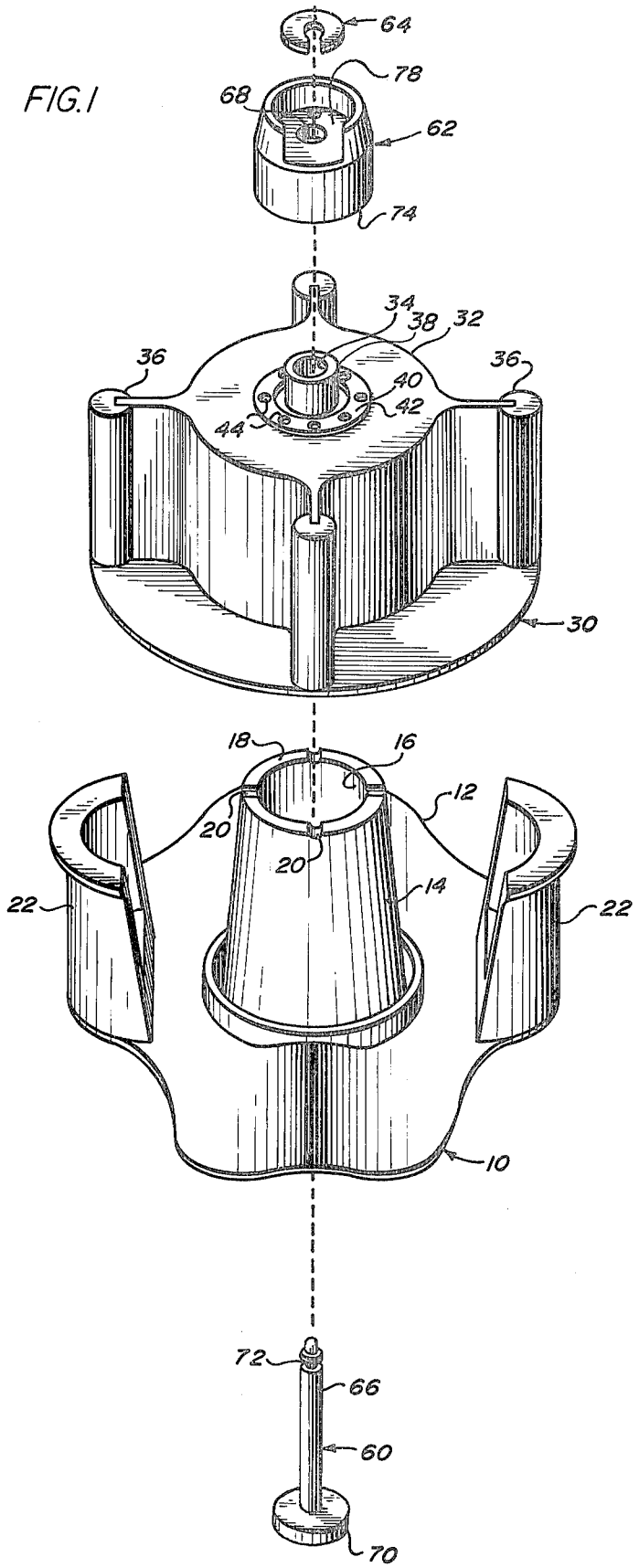
FIG. 1 is an exploded perspective view of a preferred exercising device constructed according to the teachings of this invention.

In FIG. 1 of the accompanying drawings the several parts of the exercising device of this invention are shown in perspective in their relative position to each other prior to assembly of the device. Such device comprises a base member 10 formed of a plastic, such as by means of injection molding from delrin or the like, which member is adapted to be attached to or worn on a person's waist. Said base member 10 is characterized by a contoured face 12 (see FIG. 2) to facilitate attachment to said person's waist.

Said base member 10 is further characterized by a cone-like projection 14 substantially perpendicular to contoured face 12. The projection 14 is provided with a central opening through which means, described hereinafter, pass to secure such exercising device in an assembled position. At the end 18 of said projection 14, remote from the contoured face 12, a plurality of recesses 20 are provided. The significance of such recesses will become apparent hereinafter.

At the sides of the contoured face 12 are thumb supports 22. Such supports, only one used at a time, position the thumb, hence the hand, of the wearer of such exercising device while leaving such wearer's fingers free to operate said device.

Mounted for rotation about said projection 14 is wheel 30. Said wheel 30, formed of a plastic material such as delrin or the like, is provided with a hub portion 32 having a central bore 34 and an internal cavity whose cross-section is approximately equal to that of the cross-section of projection 14. Extending radially from said hub portion 32 are a plurality of legs 36 adapted to be gripped by the user's fingers to cause rotation of said wheel 30 about the projection 14. It will be understood that the number, size and shape of such legs may vary without departing from the spirit and scope of this invention.

Extending axially beyond the outer face 36 is a cap receiving flange 38. Surrounding said flange 38 is an upraised annular portion 40 whose flat surface 42 is skewed relative to outer face 36. Such relationship is clearly apparent in FIG. 2. For reasons to be discussed later the wheel surface 42 contains a plurality of dimple-like depressions 44.

As can be seen in FIG. 2, internally the wheel 36 is characterized by sloping wall 46 and a top surface 48. Said top surface 48 is provided with a plurality of upstanding radial ribs 50, where the precise number and arrangement of ribs is typically equal to and uniformly spaced in the manner of the recesses 20. During operation of the exercising device, i.e. rotation of wheel 30 about projection 14, such ribs ride along the projection end 18 intermittantly seating themselves into the recesses 20. The operable position of a rib 50 in recess 20 is illustrated in the sectional view of FIG. 4. By means to be discussed hereinafter axial pressure between said wheel 30 and projection 14 can be varied thereby affecting the force needed to effect rotation of wheel 30.

Such variable axial pressure between wheel 30 and projection 14 is achieved by the cooperative action of pin 60, cap 62, and fastening means 64. Pin 60 is provided with a head 70 and a shank portion 66, which shank portion is adapted to pass through projection opening 16, central bore 34, and cap opening 68. The head 70 limits the axial movement of pin 60. At the opposite end of said shank portion 66 a reduced section 72 is provided for receiving fastening means 64. In the embodiment shown in FIG. 1 such fastening means is a C-ring which slides into reduced section 72 to secure the pin 60 in a fixed position relative to wheel 30 and base member 10.

As noted above, the axial pressure between said wheel 30 and projection 14 may be varied. Such variable pressure is effected by the relative rotational position of cap 62 and wheel 30. It will be recalled that wheel 30 is characterized by upraised annular portion 40 whose flat surface 42 is skewed relative to outer face 36. The base 74 of cap 62 is provided with an annular portion angled from the axial direction by the same degree as surface 42 is skewed relative to outer face 36. Additionally such angled annular portion of the cap is provided with a dimple 76 adapted to seat in a preselected depression 44. Such interaction of dimple in depression fixes the wheel 30 and cap 62 in a common rotative movement. Such axial pressure is predetermined by (1) arranging or inserting the dimple 76 into one of said depressions 44, (2) inserting pin 60 sequentially through base member projection 14, wheel 30, and cap 62, and (3) engaging fastening means 64 with reduced portion 66. The position of least pressure, hence the least force to effect the rotation of wheel 30, is where the angled annular portion of the cap lies contiguous with the upraised annular portion 40. As the cap 62 is individually turned causing the dimple 76 to rest in a different depression 44, the cap 62 is moved axially away from said wheel 30. Such new positioning of cap 62 results in greater pressure on cap surface 78 by fastening means 64. Such greater pressure is translated to increased pressure between wheel 30 and projection 14, which in turn is a direct measure of the force needed to rotate said wheel about the projection 14.

Referring now to FIG. 3, the rear of the base member 10 includes means for attaching such base member to a person's waist. In the embodiment shown such means comprise two arms 80 permanently affixed to or pivotally mounted on the rear of base member 10, said arms being adapted to slip over such person's belt or garment. When worn at such person's side the exercising device of this invention is ready for use.

To exercise the muscles along the inside of the arm, i.e. those muscles which must be developed to control a tennis player's "backhand" stroke, the thumb of the wearer is placed on the rear thumb support 22 such that said support rests at the intersection of said wearer's thumb and index finger. In this position the fingers are free to rotate wheel 30. To improve one's forehand, that is to strengthen the outer arm muscles, such wearer's thumb rests on the rear thumb support 22 at the joint of the thumb. If one wishes to strengthen the muscles of the other arm, the exercising device may be shifted to the wearer's other side and the hand positioning noted above repeated.

Although the present invention has been so far illustrated and described in its preferred embodiment, it also is to be understood that the invention is not limited only to such embodiment but may be modified or changed in various ways within the scope of the appended claims.

I claim:

1. An exercising device adapted to strengthen the deep and superficial muscles of the forearm, comprising 1. a base member for attachment to a wearer's waist, said base member having
   a. a projection means perpendicular thereto for receiving a wheel rotatable thereon, and
   b. means for attaching said base member to a wearer's waist;
2. a wheel telescopically mounted for rotation on said projection, means said wheel having
   a. a plurality of radial projections to initiate rotation thereof by the wearer of said exercising device;
3. said base member projection means having means for selectively receiving portions of said wheel to rotation of said wheel relative to said base member projection; and
4. means joining said wheel to said base member projection means, said joining means having said selective receiving means positioned therewithin whereby said joining means may be adjusted incrementally to change the resistive force necessary to be overcome in order to rotate said wheel relative to said based member projection means.

2. An exercising device according to claim 1 wherein the base member is provided with a thumb support, characterized in that during the use of such exercising device said thumb support assists in the positioning of the wearer's thumb to assure the proper use of such exercising device.

3. An exercising device according to claim 1 wherein said wheel is provided with a first face adjacent to and substantially parallel to said base member, and a second face, remote from said first face, non-parallel to said first face.

4. An exercising device according to claim 3 wherein said means joining said wheel to said base member projection means comprises a pin passing through said base member projection means and said wheel, a cap adjacent to said wheel, and means to secure said cap to said pin.

5. An exercising device according to claim 4 wherein said cap is provided with an annular face portion adapted to lie contiguous with said second face of said wheel, characterized in that such relative position of said cap and said wheel results in the least force necessary to effect rotation of said operable exercising device.

6. An exercising device according to claim 5 wherein said cap may be incrementally rotated from said contiguous position to a second predetermined position to increase the force necessary to effect rotation of said wheel.

* * * * *